US006182455B1

(12) United States Patent
Kikuyama

(10) Patent No.: US 6,182,455 B1
(45) Date of Patent: Feb. 6, 2001

(54) APPARATUS FOR CONTROLLING COOLING UNIT

(75) Inventor: Toshiya Kikuyama, Saitama-Ken (JP)

(73) Assignee: Sanyo Electronic Co., Ltd., Osaka (JP)

( * ) Notice: Under 35 U.S.C. 154(b), the term of this patent shall be extended for 0 days.

(21) Appl. No.: 09/323,825

(22) Filed: Jun. 2, 1999

(30) Foreign Application Priority Data

Jun. 2, 1998 (JP) ..... 10-153207

(51) Int. Cl.[7] ..... F25B 39/04
(52) U.S. Cl. ..... 62/181; 62/182; 62/179
(58) Field of Search ..... 62/181, 183, 184, 62/182, 158, 179, 157, 231

(56) References Cited

U.S. PATENT DOCUMENTS 3,815,378 * 6/1974 Hoenisch ..... 62/184
4,941,325 * 7/1990 Nuding ..... 62/179 X
5,144,812 * 9/1992 Mills, Jr. et al. ..... 62/186
5,605,053 * 2/1997 Otori ..... 62/181 X
5,983,653 * 11/1999 Lee ..... 62/186

FOREIGN PATENT DOCUMENTS 9-091510 4/1997 (JP) .

* cited by examiner

*Primary Examiner*—Harry B. Tanner
(74) *Attorney, Agent, or Firm*—McDermott, Will & Emery

(57) ABSTRACT

Disclosed is an apparatus for controlling a cooling unit, for instance, for an automatic vending machine. A condenser fan motor and an evaporator fan motor are of DC motors having high energy efficiency. The condenser fan motor is started by a gradually increasing Dc voltage, and the condenser fan motor and the evaporator fan motor are sequentially starred with a predetermined time interval.

9 Claims, 4 Drawing Sheets

APPARATUS FOR CONTROLLING COOLING UNIT

FIELD OF THE INVENTION

This invention relates to an apparatus for controlling a cooling unit, and more particularly to, a cooling unit-controlling apparatus comprising a compressor, a condenser fan motor, an evaporator fan motor, etc. in a cooling and heating unit for an automatic vending machine.

BACKGROUND OF THE INVENTION

FIG. 1 shows a conventional apparatus for controlling a cooling unit which comprises a microcomputer 10, n-transistors 1, 2 and 3, relays $R_1$ and $R_2$ connected between a collector of the transistor 1 and a power supply terminal $V_1$, relays $R_3$ and $R_4$ connected, respectively, between collectors of the transistors 2 and 3 and the power supply terminal $V_1$, resistances 4, 5 and 6 connected, respectively, between bases of the transistors 1, 2 and 3 and power supply terminals $V_2$ to which a DC voltage lower than a threshold voltage of the transistors 1, 2 and 3 is applied, a compressor C, a condenser fan motor CF, evaporator fan motors $EF_1$ and $EF_2$, contacts $R_{1A}$, $R_{2A}$, $R_{3A}$ and $R_{4A}$ which are turned on correspondingly in accordance with the energization of the relays $R_1$, $R_2$, $R_3$ and $R_4$, and an AC power supply AC for applying an AC voltage via the turned-on contacts $R_{1A}$, $R_{2A}$, $R_{3A}$ and $R_{4A}$ to the compressor C, the condenser fan motor CF, the evaporator fan motors $EF_1$ and $EF_2$, wherein the compressor C is driven to compress a coolant flowing in the cooling unit in an automatic vending machine, the condenser fan motor CF is driven to rotate a condenser fan, and the evaporator fan motors $EF_1$ and $EF_2$ are driven to rotate two evaporator fans for two article-cooling containers in the vending machine.

In operation, when ON signals are supplied from the microcomputer 10 to the bases of the transistors 1, 2 and 3, the transistors 1, 2 and 3 are turned on to energize the relays $R_1$, $R_2$, $R_3$ and $R_4$ so that the contacts $R_{1A}$, $R_{2A}$, $R_{3A}$ and $R_{4A}$ are turned on to drive the compressor C, the condenser fan motor CF, and the evaporator fan motors $EF_1$ and $EF_2$. Normally, the compressor C and the condenser fan motor CF are simultaneously driven by the common transistor 1, and the evaporator fan motors $EF_1$ and $EF_2$ are driven independently of the driving of the compressor C and the condenser fan motor CF.

Such a cooling unit-controlling apparatus is disclosed in, for instance, the Japanese Patent Kokai No. 9-91510 published on Apr. 4, 1997.

In the conventional cooling unit-controlling apparatus, AC motors are used for the condenser fan motor CF, the evaporator fan motors $EF_1$ and $EF_2$ to be driven by the AC power supply AC, so that there is no problem in driving a plurality of loads simultaneously, because the AC power supply AC has a sufficient capacity of electric energy.

However, there is a disadvantage in that an AC motor is worse in energy efficiency than a DC motor. For this reason, it is discussed that such DC motors are used to save energy in an automatic vending machine.

FIG. 2 shows a cooling unit-controlling apparatus using DC motors for a condenser fan motor CF, and evaporator fan motors $EF_1$ and $EF_2$, and a DC paver supply 20 for driving the DC motors CF, and $EF_1$ and $EF_2$, wherein like parts are indicated by like reference numerals and symbols as used in FIG. 1.

In operation, if the condenser fan motor CF, and the evaporator fan motors $EF_1$ and $EF_2$ are driven simultaneously by the DC power supply 20, a large amount of loads are applied to the DC power supply 20. For this reason, the DC power supply 20 is required to have a large capacity to provide the condenser fan motor CF, and the evaporator fan motors $EF_1$ and $EF_2$ with starting currents which are much bigger in current value than those in stable driving states, thereby causing the increase of the cost in manufacturing a cooling unit in the vending machine, and the increase of size for the cooling unit.

SUMMARY OF THE INVENTION

Accordingly, it is an object or the invention to provide an apparatus for a controlling a cooling unit in which the manufacturing cost is suppressed to be increased, even if DC motors are used to save electric energy.

It is another object of the invention to provide an apparatus for controlling a cooling unit, the size of which is suppressed to be increased, even if DC motors are used to save electric energy.

According to the invention, an apparatus far controlling a cooling unit, comprising:

- a first DC motor for a condenser fan and a second DC motor for an evaporator fan, respectively, provided in said cooling unit;
- a DC power supply for the first and second DC motors; and
- a controller for controlling the DC power supply to apply a controlled DC voltage to the first DC motor at the starting stage of the first DC motor, the controlled DC voltage being a DC voltage to be gradually increased.

In the apparatus, the controller controls the first and second DC motor to sequentially start with a predetermined interval.

In the apparatus, the controller controls a compressor provided in the cooling unit and at least one of the first and second DC motors to sequentially start with a predetermined interval.

In the apparatus, the controller controls the DC power supply to increase the DC voltage in a step-shaped manner.

In the apparatus, the controller controls the DC power supply to increase the DC voltage in a gradation pattern.

In the apparatus, the DC power supply comprises a first DC power supply for generating a first DC voltage by receiving an AC voltage from an AC power supply, and a second DC power supply for generating a second DC voltage smaller than said first DC voltage, and a third DC voltage smaller than the second DC voltage by receiving the first DC voltage, the third, second and first voltages being applied to the fist DC motor in sequential order of the third to first voltages.

In the apparatus, the DC power supply further comprises a transistor provided between the first DC power supply and the first DC motor, the transistor being controlled to be turned on, thereby applying the first DC voltage to the first DC motor.

In the apparatus, the second DC motor comprises a plurality of DC motors allocated for a plurality of article-cooling containers.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
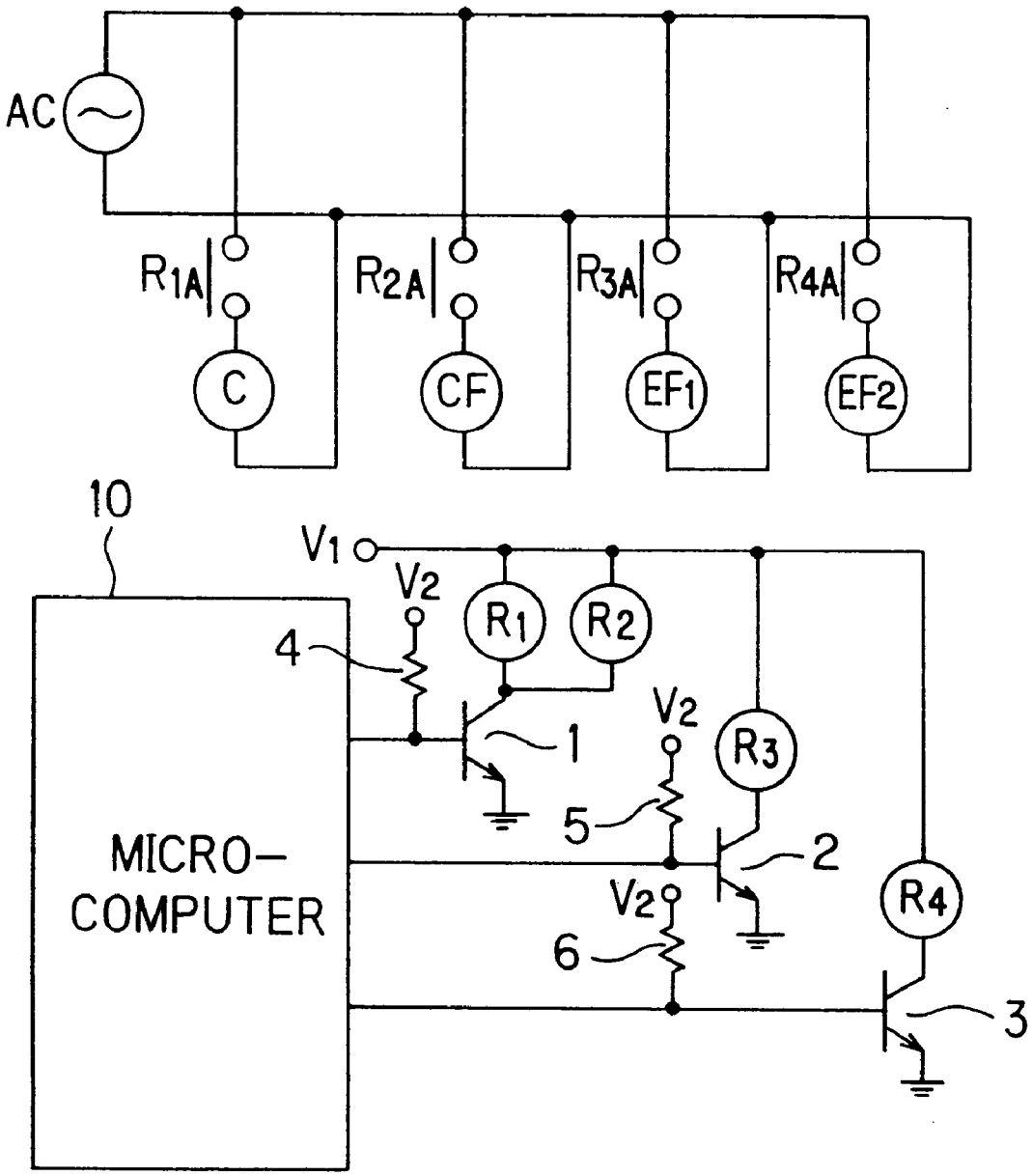
FIG. 1 PRIOR ART
FIG. 1 is a circuit diagram showing a conventional apparatus for controlling a cooling unit in automatic vending machine.
Figure 2:
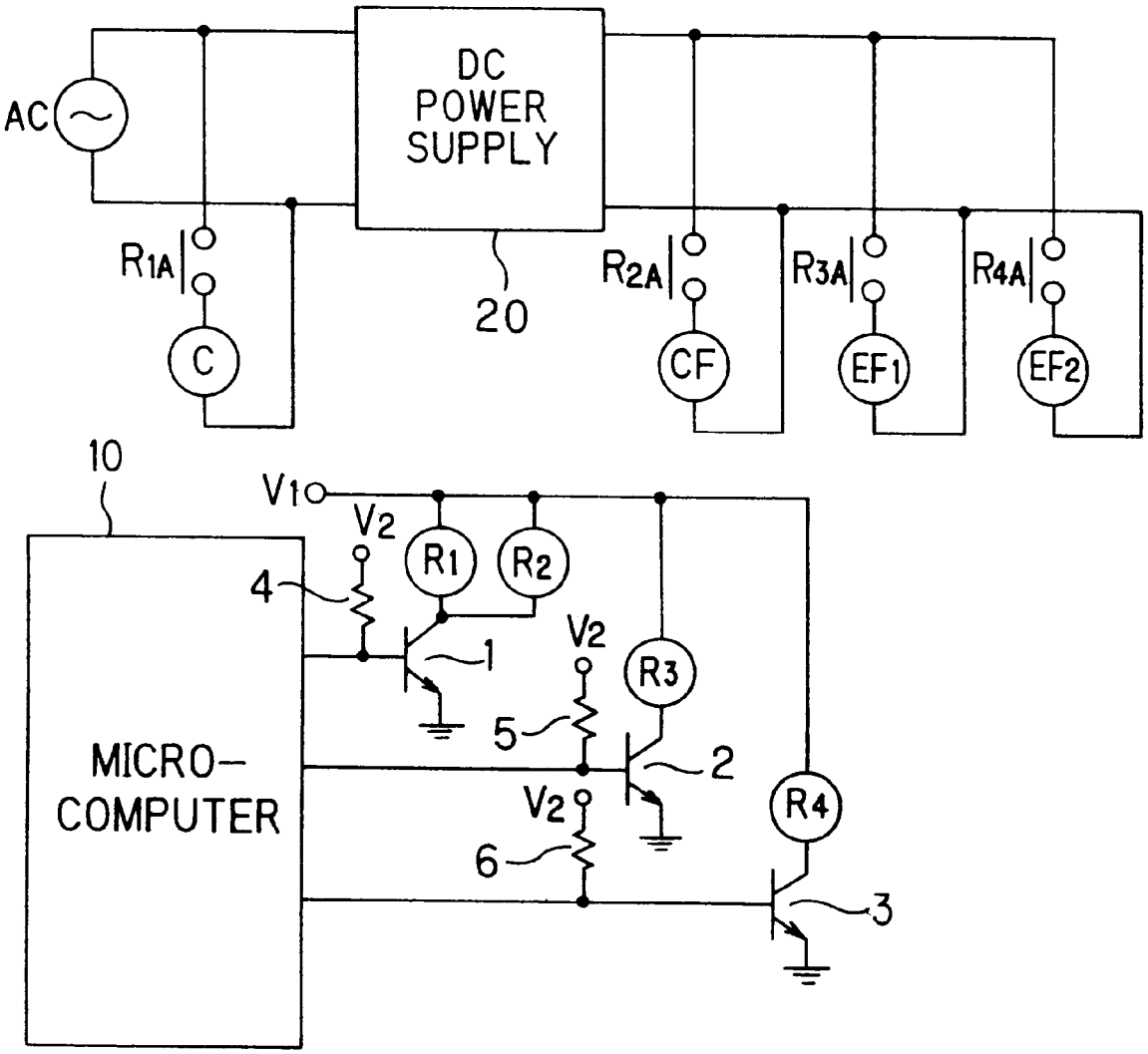
FIG. 2 is a circuit diagram showing an apparatus for controlling a cooling unit in which DC motors are used to enhance energy efficiency.
Figure 3:
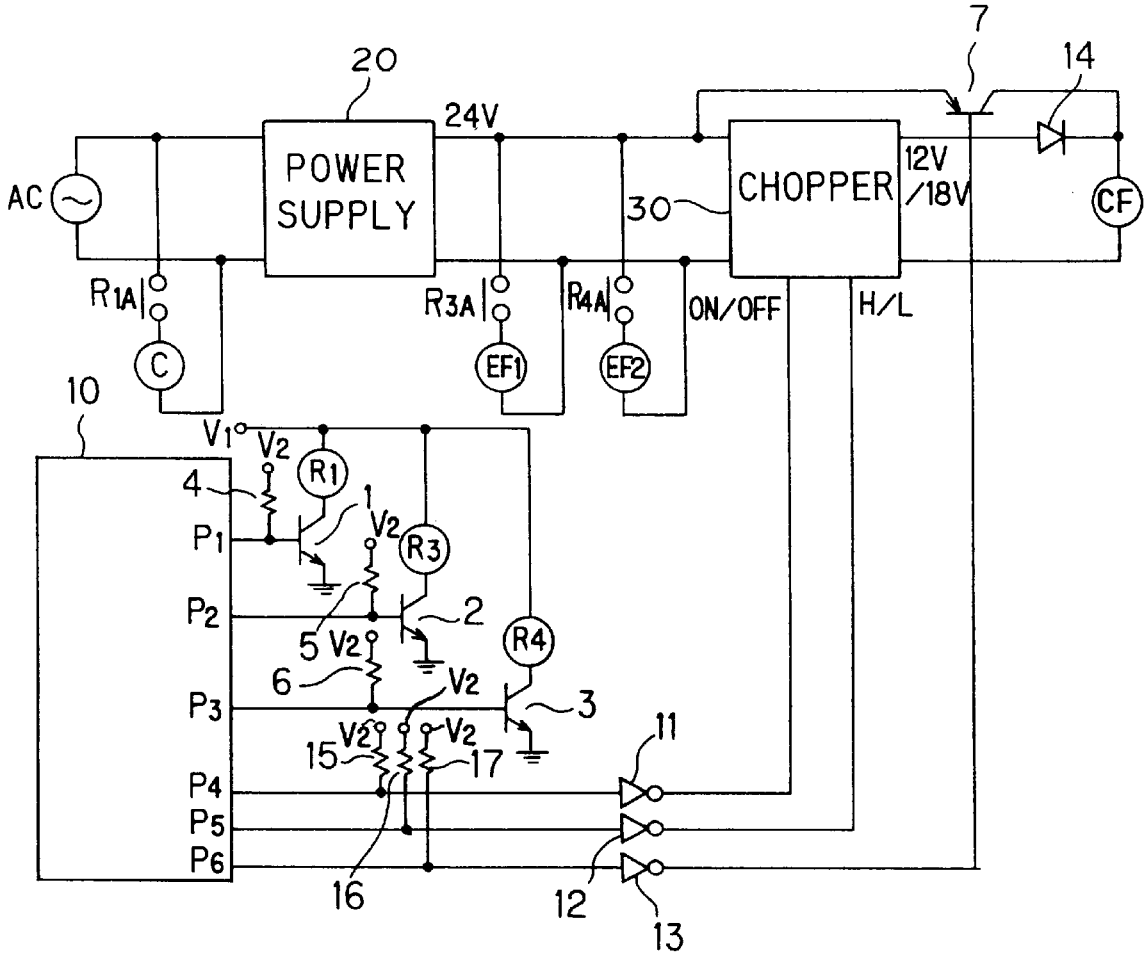
FIG. 3 is a circuit diagram showing an apparatus for controlling a cooling unit in a preferred embodiment according to the invention.

FIG. 3 shows an apparatus for controlling a cooling unit in the preferred embodiment according to the invention. The cooling unit-controlling apparatus comprises a DC power supply 20 connected to the AC power supply AC to be positioned between the compressor C and the evaporator fan motor $EF_1$, and a chopper 30 connected to the DC power supply 20 to be positioned between the evaporator fan motor $EF_1$ and the condenser fan motor CF in addition to the circuit structure as shown in FIG. 1. The chopper 30 is provided with input terminals connected to output terminals of the DC power supply 20, a control terminal connected via an inverter 11 to a part port $P_4$ of the microcomputer 10, by which the chopper 30 is turned on and off, a control terminal connected via an inverter 12 to a port $P_5$ of the microcomputer 10, at which the chopper 30 receives a high or low signal H/L, and output terminals connected to the condenser fan motor CF, a positive terminal of which is applied via a diode 14 with a DC voltage of 12 V in case of the low signal L applied to the control terminal of the chopper 30, and the De voltage of 18 V in case of the high signal H applied thereto. Further, a p-transistor 7 is provided to apply a DC voltage of 24 V from the DC power supply 20 to the condenser fan motor CF, wherein a base of the transistor 7 is connected via an inverter 13 to a port $P_6$ of the microcomputer 10.

Ports $P_1$, $P_2$ and $P_3$ of the microcomputer 1 are connected, respectively, to the bases of the transistors 1, 2 and 3. The relays $R_1$, $R_3$ and $R_4$ are provided between the collectors of the transistors 1, 2 and 3 and the power supply terminal $V_1$ (relay $R_2$ is not provided), and the resistance 4, 5 and 6 are provided between the bases of the transistors 1, 2 and 3 and the power supply terminals $V_2$.

In addition, resistances 15, 16 and 17 are connected between inputs of the inverters 11, 12, and 13 and the power supply terminals $V_2$.

In operation, the microcomputer 10 supplies OFF signals at the ports $P_1$, $P_2$, $P_3$, $P_4$ and $P_6$, and the low signal L at the port $P_5$ at the initial stage prior to the starting of the cooling unit, so that the transistors 1, 2 and 3 are not turned on not to energize the relays $R_1$, $R_3$ and $R_4$, and the chopper 30 is not turned on not to take the position of generating a DC voltage. Consequently, the compressor C, the condenser fan motor CF, and the evaporator fan motors $EF_1$ and $EF_2$ are not driven.

Figure 4:
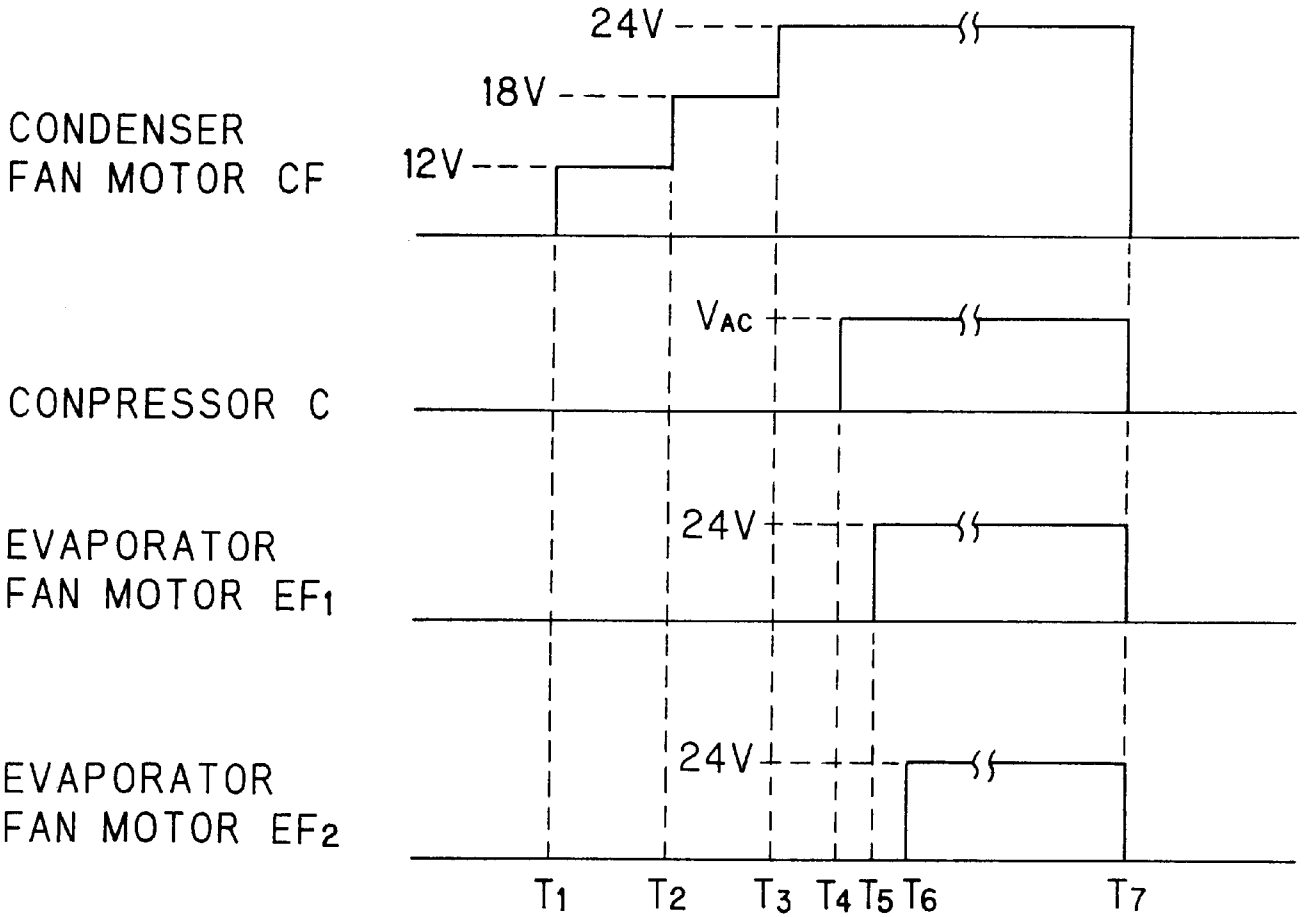
FIG. 4 is a timing chart shoving operation of the apparatus for controlling a cooling unit in the preferred embodiment in the invention.

At the time $T_1$ in the timing chart in FIG. 4, the microcomputer 10 supplies ON signal at the port $P_4$, so that the DC voltage of 12 V is applied from the chopper 30 via the diode 14 to the condenser fan motor CF which is then rotated gradually for about 3 minutes. At the time $T_2$, the microcomputer 10 supplies the high signal H at the port $P_5$ for the chopper 30 to take the position of generating a DC voltage of 18 V, so that the condenser fan motor CP is driven in accordance with the DC driving voltage of 18 V for about 3 minutes. At the time $T_3$, the microcomputer 10 supplies OFF signal at the port $P_4$ to turn the chopper 30 off, and ON signal at the port $P_6$ to turn the transistor 7 on, so that the condenser fan motor CF is driven in accordance with a normal DC driving voltage of 24 V applied via the turned-on transistor 7 from the DC power supply 20.

At the time $T_4$ (one or two minutes after the time $t_3$), the microcomputer 10 supplies ON signal at the port $P_1$ to turn the transistor 1 on, so that the relay $R_1$ is energized to turn the contact $R_{1A}$ on, thereby driving the compressor C in accordance with the application of an AC voltage $V_{AC}$ of the AC power supply AC. At the time $T_5$ (one or two minutes after the time $T_4$) and the time $T_6$ (one or two minutes after the time $T_5$), ON signals are supplied sequentially to the transistors 2 and 3 which are sequentially turned on to energize the relays $R_3$ and $R_4$, so that the contacts $R_{3A}$ and $R_{4A}$ are sequentially turned on to drive the evaporator fan motors $EF_1$ and $EF_2$ in accordance with the application of the DC voltage of 24 V from the DC power supply 20. At the time $T_7$, the condenser fan motor CF, the compressor C, and the evaporator fan motors $EF_1$ and $EF_2$ are stopped to be driven.

As described above, the starting voltage of the condenser fan motor CF, a starting load of which is large, is gradually (step manner) increased, and the starting timings of the condenser fan motor CF, and the evaporator fan motors $EP_1$ and $EF_2$ are set to be sequential with predetermined intervals, so that it is avoided to apply a heavy load to the DC power supply 20 at the stage of starting a cooling unit. Further, the starting timing of the compressor C, and the starting timings of the condenser fan motor CF and the evaporator fan motors $EF_1$ and $EF_3$ are set to differ with predetermined intervals. Thus, it is avoided that an AC input voltage supplied to the DC power supply 20 is lowered due to the starting of the compressor C, and that an output voltage of the DC power supply 20 is levered due to the increased load caused by the simultaneous starting of the condenser fan motor CF and the evaporator fan motors $EF_1$ and $EF_2$.

The advantages of the invention are summarized as follows.

(1) In accordance with the structure of controlling a DC driving voltage for a condenser fan motor to be increased in a step-shaped manner at the starting stage, the saving of energy can be realized by using DC motors having high energy efficiency for the condenser fan motor and evaporator fan motors. At the same time, a DC power supply can be small in size, and a cost for setting a cooling unit is decreased.

(2) In accordance with the structure of controlling starting timings of the condenser fan motor and the evaporator fan motors to be sequential with predetermined intervals, the DC power supply can be smaller in size.

(3) In accordance with the structure of controlling a starting timing of a compressor and starting timings of the condenser fan motor and the evaporator fan motors to differ with predetermined intervals, it can be avoided that the lowering of an input voltage for the compressor at the starting stage thereof and the increase of load caused by the driving of the condenser fan motor and the evaporator fan motors occur simultaneously. Thus, the DC power supply can be further smaller in size.

Although the invention has been described with respect to the specific embodiments for complete and clear disclosure, the appended claims are not to be thus limited but are to be construed as embodying all modification and alternative constructions that may occur to one skilled in the art which fairly fall within the basic teaching herein set forth.

What is claimed is:

1. An apparatus for controlling a cooling unit, comprising:

a first DC motor for a condenser fan and a second DC motor for an evaporator fan provided in said cooling unit;

a DC power supply for said first and second DC motors; and a controller for controlling said DC power supply to apply a controlled DC voltage to said first DC motor at the starting stage of said first DC motor, said controlled DC voltage being lower than a DC power supply voltage and controlled to be gradually increased at predetermined time intervals.

2. The apparatus as defined in claim 1, wherein:

said controller controls said second DC motor to sequentially start after said first DC motor is driven for said predetermined time interval.

3. The apparatus as defined in claim 1, wherein:

said controller controls a compressor provided in said cooling unit and at least one of said first and second DC motors to sequentially start with a predetermined time interval.

4. The apparatus as defined in claim 1, wherein:

said controller controls said DC power supply to increase said DC voltage in a step-shaped manner.

5. The apparatus as defined in claim 1, wherein:

said controller controls said DC power supply to increase said DC voltage in a gradation pattern.

6. The apparatus as defined in claim 1, wherein:

said DC power supply comprises a first DC power supply for generating a first DC voltage by receiving an AC voltage from an AC power supply, and a second DC power supply for generating a second DC voltage smaller than said first DC voltage, and a third DC voltage smaller than said second DC voltage by receiving said first DC voltage from said first DC power supply, said third, second and first DC voltages being applied to said first DC motor in sequential order of said third to first voltages.

7. The apparatus as defined in claim 6, wherein:

said DC power supply further comprises a transistor provided between an output side of said DC power supply and a power supply side of said first DC motor, said transistor being controlled to be turned-on for said predetermined time interval, thereby applying said third, second and first DC voltages to said first DC motor in sequential order of said third to first DC voltages, and said transistor being controlled to be turned-off after the elapse of said predetermined time interval, thereby preventing said second and third DC voltages from being applied to said first DC motor and applying said first DC voltage to said first DC motor.

8. The apparatus as defined in claim 1, wherein:

said second DC motor comprises a plurality of DC motors allocated for a plurality of article-cooling containers.

9. The apparatus as defined in claim 1, wherein:

said DC power supply further comprises a switching circuit provided between an output side of said DC power supply and a power supply side of said first DC motor, said switching circuit being controlled to be turned-on after the elapse of said predetermined time interval, thereby preventing said controlled DC voltage from being applied to said first DC motor and applying said DC power supply voltage to said first DC motor directly.

* * * * *